United States Patent [19]

Goel

[11] 4,023,894

[45] May 17, 1977

[54] TRANSFER APPARATUS

[75] Inventor: Narendra S. Goel, Henrietta, N.Y.

[73] Assignee: Xerox Corporation, Stamford, Conn.

[22] Filed: July 11, 1975

[21] Appl. No.: 595,196

Related U.S. Application Data

[63] Continuation-in-part of Ser. No. 420,747, Nov. 30, 1973.

[52] U.S. Cl. ..... 355/3 R; 101/DIG. 13; 346/153

[51] Int. Cl.[2] ..... G03G 15/00

[58] Field of Search ..... 355/3 R, 3 TR, 3 TE, 355/3 CH, 3 BE; 101/173, 250, 382 MN, DIG. 13, 186; 346/74 ES, 74 EB, 74 J, 74 P

[56] References Cited

UNITED STATES PATENTS

| | | | |
|---|---|---|---|
| 3,244,083 | 4/1966 | Gundlach | 355/3 R |
| 3,633,543 | 1/1972 | Pitasi et al. | 355/3 R X |
| 3,647,292 | 3/1972 | Weikel | 355/3 R |
| 3,781,105 | 12/1973 | Meagher | 355/3 R |
| 3,832,053 | 8/1974 | Goel et al. | 355/3 R |
| 3,832,055 | 8/1974 | Hamaker | 355/3 R |
| 3,866,572 | 2/1975 | Gundlach | 355/3 R X |

*Primary Examiner*—Fred L. Braun

[57] ABSTRACT

Copying apparatus in which an image of charged particles of imaging material is transferred from one supporting surface to a sheet of support material, while the sheet of support material is held on an apertured vacuum belt and an electrical transfer field is applied thereto, where the vacuum belt comprises electrically relaxable material to prevent print-out of the vacuum apertures on the support material. The coping apparatus includes a multiple registered transfer system for color copying with reciprocating of the supporting vacuum belt.

5 Claims, 3 Drawing Figures

TRANSFER APPARATUS

BACKGROUND OF THE INVENTION

This is a continuation-in-part of copending application Ser. No. 420,747, filed Nov. 30, 1973, the specification of which is incorporated by reference herein to the extent it is relevant.

This invention relates to an electrostatographic printing machine, and more particularly concerns an improved transfer system for use therein.

In electrostatographic printing, an electrostatic latent charge pattern is created and reproduced in viewable form. The field of electrostatography includes electrophotography and electrography. Electrophotography employs a photosensitive medium to form, with the aid of electromagnetic radiation, an electrostatic latent charge pattern. Contrawise, electrography utilizes an insulating medium to form, without the aid of electromagnetic radiation, the electrostatic latent charge pattern. The process of transferring toner particles deposited on the electrostatic latent charge pattern, in image configuration, to a sheet of support material, is employed in both of the preceding types of electrostatographic printing.

Hereinafter, a color electrophotographic printing machine will be described as an illustrative embodiment of the foregoing process wherein the transfer apparatus of the present invention may be employed. However, the present invention is equally applicable to black and white or other electrostatographic printing systems in which an image developed on, or transferred to, one single support surface. In the process of electrophotographic printing, for example, as disclosed in U.S. Pat. No. 2,297,691 issued to Carlson in 1942, an image bearing member or photosensitive element having a photoconductive insulating layer is charged to a substantially uniform potential in order to sensitize the surface thereof. Thereafter, the charged photoconductive surface is exposed to a light image of an original document. As a consequence of the exposure, the charge is selectively dissipated in the irradiated areas in accordance with the light intensity projected onto the charged photoconductive surface. This records an electrostatic latent charge pattern or an electrostatic latent image corresponding to the original document. Development of the electrostatic latent image is achieved by bringing a developer mix into contact therewith. Typical developer mixes employ colored thermoplastic particles, i.e., toner particles, which are mixed with ferromagnetic granules, i.e., carrier granules. The developer mix is selected such that the toner particles acquire the appropriate charge relative to the electrostatic latent image recorded on the photoconductive surface. As the developer mix is moved into contact with the photoconductive surface, the greater attractive force of the electrostatic latent image recorded thereon causes the toner particles to be separated from the carrier granules and adhere to the electrostatic latent image. Thereafter, the toner powder image adhering to the electrostatic latent image is transferred to a sheet of support material such as a sheet of paper, or a thermoplastic sheet amongst others. The toner powder image is then permanently affixed thereto.

One type of transfer apparatus is described in U.S. Pat. Nos. 3,357,325, issued to R.H. Eichorn et al, Dec. 12, 1967, or 3,697,170, issued to G. C. Bhagat, Oct. 10, 1972 or 3,404,418, issued to J. Fantuzzo, Oct. 8, 1968.

As disclosed therein, a transfer corona generating device is disposed behind an endless belt arranged to move a sheet of support material into contact with the photoconductive drum. The transfer corona generating device applies a charge to the back of the belt. The electrostatic charge placed on the back of the belt by the corona generating device attracts the powder image from the drum surface to the sheet of support material.

With the advent of multi-color electrophotographic printing, successive layers of toner powder images are transferred to the sheet of support material in superimposed registration with one another. In multi-color electrophotographic printing, successive single color electrostatic latent images are created on the photoconductive surface and developed with correspondingly colored toner particles. Thereafter, each single color toner powder image is transferred to the sheet of support material in superimposed registration with the prior one. Thus, it is evident that the sheet of support material moves in a recirculating path to receive successive toner powder images in superimposed registration with one another. This may be achieved by the employment of a transfer roll. The transfer roll is electrically biased to generate a high voltage discharge in the proximity of the surface of the sheet of support material or it may be applied by means of a conductive cylinder in contact with the paper as is disclosed in U.S. Pat. No. 2,807,233, issued to Fitch in 1957. As described therein, a sheet of support material is interposed between the conductive roller and a surface having the toner powder image thereon. A charge of opposite polarity from the toner particles is deposited on the back side of the sheet of support material which attracts the toner powder image thereto. U.S. Pat. No. 3,612,677, issued to Langdon et al. in 1971 also describes an electrically biased transfer roll. This system is particularly adapted for multi-color electrophotographic printing. As disclosed therein, a transfer roll moves the sheet of support material in a recirculating path. The transfer roll is biased electrically to a potential of sufficient magnitude and polarity to attract electrostatically toner particles from the electrostatic latent image recorded on the photoconductive surface to the sheet of support material. The transfer roll rotates in synchronism with the photoconductive drum. Inasmuch as the sheet of support material is secured releasably on the transfer roll for movement in a recirculating path therewith, successive toner powder images may be transferred thereto in superimposed registration with one another. It should be noted that a transfer roll requires some mechanism for securing the sheet of support material to the transfer roll. This is frequently accomplished by employing gripper fingers arranged to grasp the leading edge of the sheet of support material, thereby securing the sheet of support material to the transfer roll. However, an arrangement of this type will cause edge deletion, i.e., copying without a bleed. Moreover, the foregoing type of system is relatively complex and expensive to manufacture. In addition, it requires a change in the paper feed path. Generally, the paper feed path employs a plurality of endless conveyor belts adapted to advance the sheet of support material from the sheet tray to the catch tray for subsequent removal therefrom by the operator. The conveyors transport the sheet of support material sequentially through the respective processing stations to produce the desired copy thereon. However, with the employment of a transfer roll, this simple feed path is interrupted and additional complexities are added to the system. Thus, it would be highly desirable to employ a flat surface or endless conveyor belt in lieu of the transfer roll when creating multi-color copies.

In addition to the Eichorn et al. and other patents noted above, some other patents disclosing endless belts for transporting copy sheets through a transfer station and voltage biasing systems therefor are disclosed in U.S. Pats. Nos. 3,647,292, issued Mar. 7, 1974, to D. J. Weikel, Jr., teaching vacuum belts; 3,832,053, issued Aug. 27, 1974, to the present inventor and G. M. Fletcher (see Col. 3, lines 5–11); and 3,846,020, issued Nov. 5, 1974, to G. M. Fletcher (see Col. 2, top, and Col. 5, top).

Accordingly, it is a primary object of the present invention to improve the apparatus for transferring toner powder images from a photoconductive surface to a sheet of support material.

The use of electrically relaxable material for biased transfer rollers is taught in Xerox U.S. Pats. Nos. 3,781,105, issued Dec. 25, 1973, to T. Meagher and 3,702,482, issued Nov. 7, 1972, to C. Dolcimascolo, et al. The general properties of, and materials for, electrically relaxable material are described in these patents.

Xerox U.S. Pat. No. 3,633,543, issued Jan. 11, 1972, to C. R. Pitasi discloses a xerographic biased transfer roller having a resilient material surface layer which passes air therethrough for sheet retention. The specified material, however, is conductive rubber or a thin insulator, and the air passages are formed by pin holes through this material.

A particularly relevant reference noted is Xerox U.S. Pat. No. 3,832,055, issued Aug. 27, 1974, to R. A. Hamaker, filed June 5, 1973. This patent discloses a foraminous biased transfer roller in which the transfer bias is applied to an electrically conductive core of the roller, and also a vacuum is applied to the interior of the roller to hold the copy sheet against the porous roller during the transfer operation. Although a roller is disclosed, it is stated in Col. 4 that the term "roller" as used therein is also intended to read broadly on equivalent structures such as moving endless belts of the same foraminous materials. Col. 6, (middle) of this same U.S. Pat. No. 3,832,055 states that the foraminous material may be either highly insulative or ". . . resistive, or at least semi-conductive, such as an electrically relaxable material as disclosed in the above-cited references on bias transfer rollers. In this second mode at least part of the transfer bias charge will be conducted out toward the outer surface of the transfer roller." However, it is noted that this Hamaker reference teaches only a thick foraminous material where the vacuum passageways through this material are small, elongated and convolute, and the material is being compressed in the nip area to a thickness substantially less than its normal uncompressed thickness, preferably for closing the air passages through the material in the transfer area. It has been found that such small elongated vacuum passages in foam material tend to eventually become clogged by paper lint from the copy sheet, dust, xerographic toner, to which it is directly exposed thereby, etc., requiring cleaning to remain open. (Note that a cleaning system is disclosed in this patent itself). Further, of course, foam material has limitations as to its durability and mechanical strength.

In contrast, the present structure utilizes a relatively thin and solid belt with much shorter, larger, and nonconvolute vacuum apertures through the belt for greatly reduced clogging tendencies and more positive sheet retention. The transport belt of the present invention is uncompressed and its vacuum apertures are not shut by compression in the transfer region. Since there is no blockage of the vacuum holes by compression there can be a more positive lead edge posttransfer stripping of the copy sheet from the photoreceptor. This is a critical test of the vacuum transport's effectiveness in overcoming the electrostatic forces tacking the copy sheet onto that original imaging surface. Another advantage here is that conventional corona detack (neutralizing) emissions may be applied directly to the back of the belt by a detack corotron downstream from the transfer corotron.

All of these above-noted patents are incorporated by reference herein to the extent they are relevant.

Accordingly, it is a primary object of the present invention to improve the apparatus for transferring toner powder images from a photoconductive surface to a sheet of support material.

There is disclosed herein an endless vacuum belt system for retaining copy sheets during the image transfer thereto, which belt is electrically relaxable, to thereby reduce the uneveness in transfer fields which otherwise may be associated with the vacuum apertures in the belt, by decreasing the voltage drop across the belt during transfer.

There is also disclosed herein a vacuum support member having a generally planar surface for securing releasably thereto the sheet of support material. The support member is operatively associated with the movable particle bearing member, being arranged for reciprocating movement to effect the transfer of successive layers of charge particles from the particle bearing member to the sheet of support material in superimposed registration with one another. Means are provided for reciprocating the support member so that the forward movement thereof is in synchronism with the movement of the particle bearing member, thereby transferring the charged particles thereon to the sheet of support material. The return movement of the support member locates it in a position to initiate the transfer of the next successive layer of charged particles. In this manner, successive layers of charged particles are transferred from the particle bearing member to the sheet of support material, in superimposed registration with one another.

BRIEF DESCRIPTION OF THE DRAWINGS

Other objects and advantages of the present invention will become apparent upon reading the following detailed description and upon reference to the drawings, in which.

Figure 1:
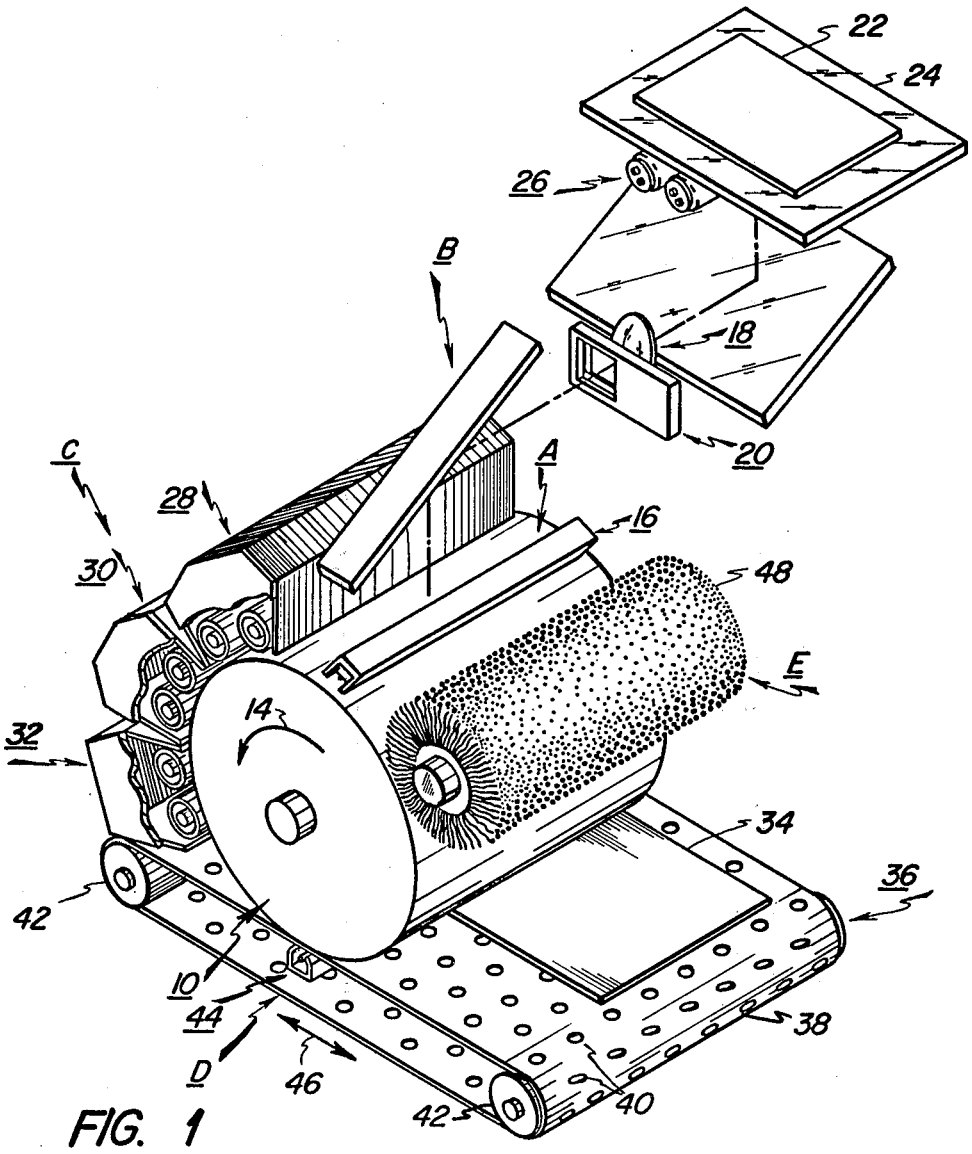
FIG. 1 is a schematic perspective view of an exemplary color electrophotographic printing machine incorporating the features of the present invention therein.

While the present invention will be described in connection with a preferred embodiment, it will be understood that it is intended to cover all alternatives, modifications and equivalents as may be included within the spirit and scope of the invention as defined by the appended claims.

DETAILED DESCRIPTION OF THE DISCLOSED EMBODIMENT OF THE INVENTION

For a general understanding of the disclosed electrophotographic printing machine in which the invention may be incorporated, reference is had to the drawings, wherein like reference numerals have been used throughout to designate like elements. Although the embodiment of FIGS. 1 and 2 is a specific color electrophotographic printing machine, it should become evident from the following discussion that the invention is well suited for use in a wide variety of electrostatographic printing machines and is not necessarily limited in its application to the particular embodiment shown herein.

Figure 2:
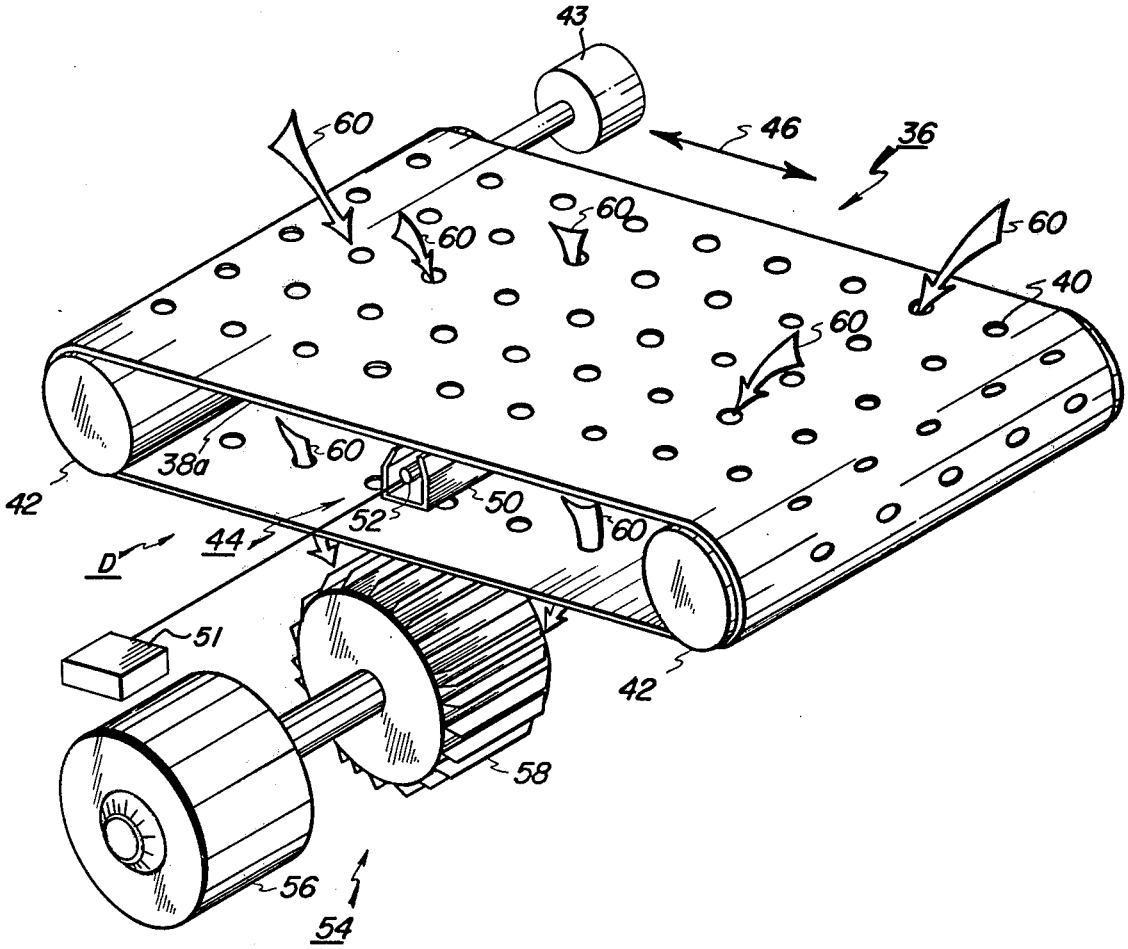
FIG. 2 is a schematic perspective view of the transfer apparatus employed in the FIG. 1 printing machine.

As shown in FIG. 1, the printing machine employs an image or particle bearing member having a drum 10 with a photoconductive surface 12 secured to and entrained about the exterior circumferential surface thereof. Drum 10 is mounted rotatably within the machine frame (not shown) and moves in the direction of arrow 14. Preferably, photoconductive surface 12 has a relatively panchromatic response to white light. One type of suitable photoconductive material is disclosed in U.S. Pat. No. 3,655,377, issued to Sechak in 1972. A series of processing stations are located such that as drum 10 rotates in the direction of arrow 14 it passes sequentially therethrough. Drum 10 is driven at a predetermined speed by a drive motor (not shown) relative to the various machine operating mechanisms. A timing disc having a plurality of spaced slits in the periphery thereof is mounted on the shaft of drum 10 and rotates in synchronism therewith. A light source develops light rays which pass through the slits in the timing disc and are detected by a photosensor. The signal from the photosensor triggers the machine logic to coordinate the operations at each station producing the proper sequence of events thereat. Thus, the machine logic in association with the timing disc actuates the operating mechanism of the printing machine to create a multicolor copy from the colored original document.

Initially, drum 10 advances photoconductive surface 12 through charging station A. Charging station A has positioned thereat a corona generating device indicated generally at 16. Corona generating device 16 extends in a generally transverse direction across photoconductive surface 12. This readily enables corona generating device 16 to charge photoconductive surface 12 to a relatively high substantially uniform potential. The foregoing type of corona generating device may be of the type described in U.S. Pat. No. 2,778,946, issued to Mayo in 1957.

Thereafter, drum 10 rotates to exposure station B where a color filtered light image of the original document is projected onto charged photoconductive surface 12. Exposure station B includes thereat a moving lens system, generally designated by the reference numeral 18, and a color filter mechanism shown generally at 20. A suitable moving lens system is disclosed in U.S. Pat. No. 3,062,108, issued to Mayo in 1962. As shown in FIG. 1, an original document 22, such as a sheet of paper, book or the like is placed face down upon transparent viewing platen 24. Lamp assembly 26, filter mechanism 20 and lens 18 move in a timed relationship with drum 10 to scan successive incremental areas of original document 22 disposed upon platen 24. This scanning operation creates a flowing light image of original document 22 which irradiates charged photoconductive surface 12. Filter mechanism 20 is adapted to interpose select color filters into the optical light path. The appropriate color filter operates on the light rays transmitted through lens 18 to record an electrostatic latent image on photoconductive surface 12 corresponding to a preselected spectral region of the electro-magnetic wave spectrum, hereinafter referred to as a single color electrostatic latent image.

Afer exposure, drum 10 rotates the single color electrostatic latent image recorded on photoconductive surface 12 to development station C. Development station C includes three individual developer units, generally indicated by the reference numerals 28, 30 and 32, respectively. A suitable development station employing a plurality of developer units is disclosed in co-pending application Ser. No. 255,259, filed on May 22, 1972, now U.S. Pat. No. 3,854,449. Preferably, the developer units are all of a type referred to generally as magnetic brush developer units. A typical magnetic brush developer unit employs a magnetizable developer mix having carrier granules and toner particles therein. The developer mix is continually brought through a directional flux field to form a brush thereof. The single color electrostatic latent image recorded on photoconductive surface 12 is developed by bringing the brush of developer mix into contact therewith. Each of the respective developer units contain discretely colored toner particles correspondong to the complement of the spectral region of the wave length of light transmitted through filter 20. For example, a green filtered electrostatic latent image is rendered visible by depositing green absorbing magenta toner particles thereon. Similarly, blue and red latent images are developed with yellow and cyan toner particles, respectively.

Drum 10 is next rotated to transfer station D where the toner powder image adhering electrostatically to photo-conductive surface 12 is transferred to a sheet of support material (a copy sheet) 34. Transfer station D includes the transfer apparatus of the present invention, designated generally by the reference numeral 36. Transfer apparatus 36 is characterized by an endless belt 38 having a multiplicity of apertures 40 therein. Endless belt 38 is entrained about a pair of spaced rollers 42. Corona generator 44 is disposed beneath endless belt 38 in the nip defined by drum 10 and belt 38. In this manner, corona generating device 44 produces a spray of ions which charge the back side of belt 38 to the proper polarity and magnitude for attracting the toner particles from the electrostatic latent image recorded on photoconductive surface 12 to support material 34. Endless belt 38 is adapted to be reciprocated so that successive layers of toner particles may be transferred to support material 34 in superimposed registration with one another. Transfer apparatus 36 will be described hereinafter in greater detail with reference to FIG. 2.

Referring now to the sheet feeding path, support material 34 is advanced from a stack thereof. A feed roll, in operative communication with a retard roll, advances and separates the uppermost sheet from the stack. The advancing sheet moves into a chute which directs it onto endless belt 38. Support material 34 is releasably secured to endless belt 38. This may be achieved by the endless belt having a plurality of apertures therein with a vacuum therebehind, is described in FIGs. 1–3. As the sheet of support material passes through transfer station D, the transfer of the toner powder image from photoconductive surface 12 to support material 34 occurs due to the applied electrostatic field. After a plurality of successive toner powder images have been transferred to support material 34, the support material is separated from endless belt 38 and advanced to the fixing station (not shown), or carried on it through the fixing station.

While the transfer apparatus of the present invention has been described as employing a corona generating device of the type shown in FIGS. 1 and 2, it will be obvious to one skilled in the art that many variations may be employed. For example, one or a plurality of electrically biased transfer rolls may be positioned beneath the belt surface to produce the electrostatic field for transferring toner particles from the photoconductive surface to the sheet of support material.

At the fixing station, a fuser applies sufficient heat to permanently affix the multi-layered toner powder image to support material 34. One type of suitable fuser is described in U.S. Pat. No. 3,498,592, issued to Moser et al. in 1970. After the fusing process, support material 34 with the toner powder image affixed permanently thereto may be advanced by a belt conveyor (not shown) to a catch tray (not shown) for subsequent removal from the printing machine by the operator.

Although a preponderance of the toner particles are transferred to support material 34, invariably some residual toner particles remain on photoconductive surface 12 after the transfer of the toner powder image therefrom. These residual toner particles are removed from photoconductive surface 12 as it passes through cleaning station E. Here the residual toner particles are initially brought under the influence of a cleaning corona generating device (not shown) adapted to neutralize the electrostatic charge on the toner particles and photoconductive surface 12. Toner particles are then cleaned from photoconductive surface 12 by a rotatably mounted fibrous brush 48 in contact therewith. A suitable brush cleaning device is described in U.S. Pat. No. 3,590,412, issued to Gerbasi in 1971. In this manner, residual toner particles remaining on photoconductive surface 12 after each transfer operation are readily removed therefrom.

It is believed that the foregoing description is sufficient for purposes of the present application to depict the general operation of the color electrophotographic printing machine embodying the teachings of the present invention therein.

Referring now to the specific subject matter of the present invention, FIG. 2 depicts a transfer apparatus 36 associated with photoconductive surface 12 of drum 10. Transfer apparatus 36 includes an endless belt 38 having a plurality of apertures 40 therein. Endless belt 38 is entrained about a pair of spaced opposed substantially parallel rollers 42. At least one roller 42 is driven by an oscillating motor 43 first in one direction then the other direction to reciprocate endless belt 38 in the direction of arrow 46. The reciprocating movement of endless belt 46 is keyed to the machine logic. Thus, when the first toner powder image is deposited on the electrostatic latent image recorded on photoconductive surface 12, the timing disc on drum 10 actuates roller 42 to advance endless belt 38 in the forward direction such that support material 34 situated releasably thereon moves in synchronism with drum 10. This enables the toner powder image on photoconductive surface 12 to be transferred to support material 34. It should be noted that the tangential velocity of drum 10 is the same as the forward linear velocity of endless belt 38. Thereafter, the timing disc triggers the machine logic so that endless belt 38 is moved in the return direction preparatory for receiving the next successive layer of toner particles in superimposed registration with the previously transferred layer of toner particles on support material 34. In this manner, successive layers of toner particles may be transferred to support material 34 in the superimposed registration with one another.

Preferably, endless belt 38 is made from a 30—80 mils (0.76–2 mm) thick electrically relaxable materials, such as resistive polyurethane rubber. Reinforcing fibers may be utilized and the belt can be made seamless by centrifugal casting if desired. The belt thickness should be uniform and greater than appproximately 20 mils (0.5 millimeters) to render it non-stretching and to provide improved wear and other mechanical advantages. The apertures in the belt preferably have openings of greater than approximately 0.5 millimeters.

Corona generating device 44 is disposed beneath the upper flight 38*a* of endless belt 38. Corona generating device 44 includes an elongated shield 50 preferably made from a conductive material such as an aluminum extrusion. Elongated shield 50 is substantially U-shaped and may be grounded or, in lieu thereof, biased to a suitable electrical voltage level. A discharge electrode 52 is mounted in the chamber defined by U-shaped shield 50. Discharge electrode 52 is, preferably, a fine coronode wire extending longitudinally along the length of shield 50. The coronode wire 52 is electrically voltage biased to produce a flow of ions therefrom. The ion flow is sprayed on the back side of support material 34, thereby causing the toner particles to be electrostatically transferred from photoconductive surface 12 to support material 34. Coronode wire 52 is generally excited by power supply 51 to preferably about 4000 volts, though this voltage may be adjusted suitably to effect good transfer through successive layers of toner powder images deposited on support material 34.

Endless belt 38 contains a plurality of apertures or holes 40 therein through which a vacuum can be imposed on support material 34 to prevent it from slipping. Exemplary vacuum applying means 54 includes a motor 56 driving a vaned member 58 mounted thereon. Motor 56 is adapted to rotate vaned member 58 such that air flows in the direction of arrows 60, thereby creating a vacuum which tacks support material 34. to endless belt 38. Baffles (not shown) are employed to direct the air flow around corona generating device 44. In this manner, corona generating device 44 is isolated from the air flow and the flow of ions toward the back surface of the sheet of support material is not opposed by the air flow in the direction of arrows 60. Thus, it is evident that successive single color toner powder images may be transferred to support material 34 from photoconductive surface 12 in superimposed registration with one another via the utilization of the transfer apparatus of the present invention.

As hereinbefore described, support material 34 is advanced to endless belt 38. Endless belt 38 moves support material 34 in the forward direction at the same linear velocity as the tangential velocity of drum 10 to enable the first color toner powder image to be transferred thereto. Transfer is effected by spraying ions onto the back surface of support material 34. The ion spray is achieved by a corona generating device suitably excited to produce ions having the proper magnitude and polarity to attract toner particles from photoconductive surface 12 to support material 34. After the first layer of toner particles has been transferred to support material 34, endless belt 38 is moved in the return direction to its initial position so that it may once again be advanced in the forward direction in synchronism with drum 10. In this manner, the next successive single color toner powder image may be transferred to support material 34 in superimposed registration with the previously transferred toner powder image. The foregoing cycle of events is repeated a plurality of cycles (in this case three cycles) so that a multi-color toner powder image may be created on support material 34. Thereafter, the timing disc actuates the machine logic to deactuate motor 56 reducing the vacuum holding support material 34 to endless belt 38. This permits the support material to be advanced onto the next successive endless conveyor which moves it into the fusing apparatus. As previously discussed, the fusing apparatus permanently affixes the multi-layered toner powder image to support material 34. The fused toner powder image on the support material is then advanced by a plurality of endless belts to catch tray where the operator may remove the multi-color copy.

An alternate embodiment of the present invention employs an otherwise electrically biased belt, in lieu of a belt and corona generating device, as disclosed in the above-cited references.

There are basically three types of electrically biased belts. These are a dielectric belt, an electrically relaxable belt and a conductive belt. With a dielectric belt, the voltage drop across a belt in any region near the transfer nip is a function of the dielectric constant and the thickness of the belt and not of its resistivity. Thus, the dielectric belt thickness reduces the effective transfer field strength. As noted, the dielectric belt can cause uneven transfer fields in the vacuum hole areas, and this can cause visible copy defects unless the belt is less than a few mils in thickness. The conductive belt has a voltage drop across the belt in the transfer nip which is zero, but it would laterally conduct the transfer charges and apply them over the entire belt. This would be undesirable and would create undesirable pre-transfer pre-nip fields. The electrically relaxable belt behaves like a lossy dielectric and the voltage drop across the belt decreases while the belt is moving through the transfer nip. The drop depends on its speed, the bulk resistivity and dielectric thickness, and the electrical field.

Figure 3:
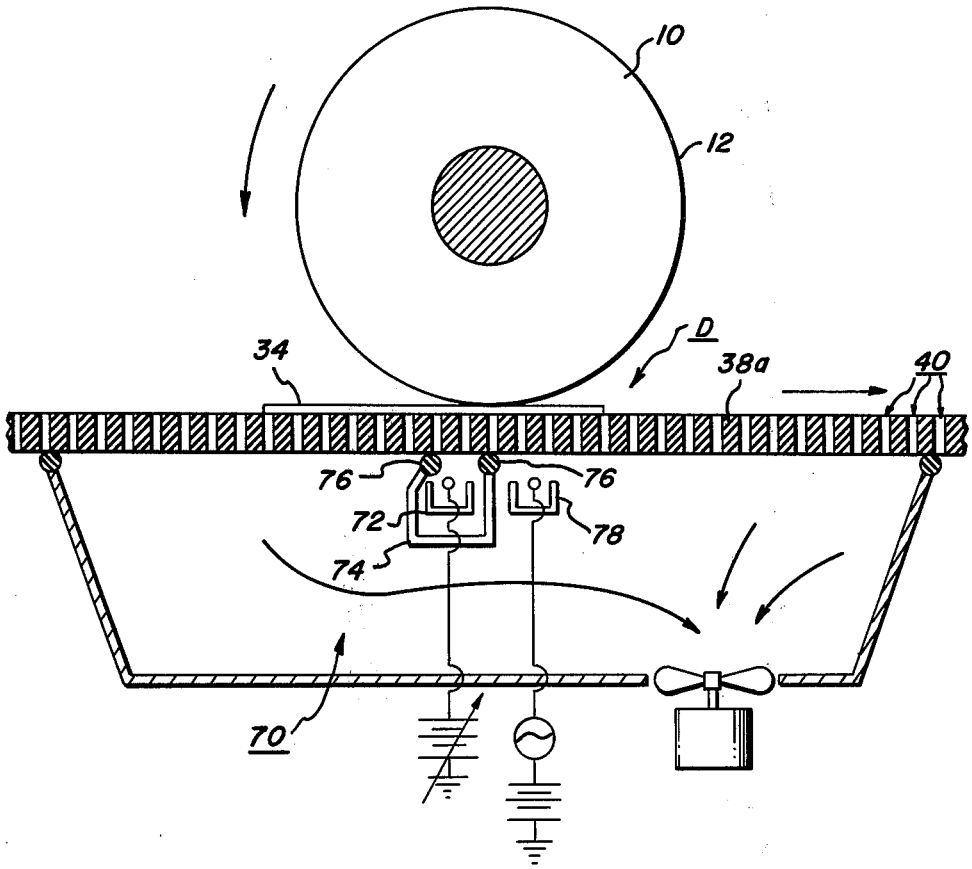
FIG. 3 is a schematic cross-sectional side view of a similar alternative embodiment of the transfer apparatus employed in the FIG. 1 printing machine.

Referring now specifically to FIG. 3, there is shown therein in cross-section a slightly different embodiment of the present invention. The vacum sheet transport belt 38, its drives, etc., and the photoreceptor 10 may be identical to those of FIGS. 1 and 2. A vacuum plenum 70 is positioned under the upper flight 38*a* of the belt, spanning the transfer station D, so as to positively retain the copy sheet 34 on the belt in and through transfer. It will be appreciated that end seals (not shown), close the two ends of the plenum 70 at the sides of the belt. Transfer is accomplished by a corona generator 72 spaced from the back of the belt flight 38 in the transfer station in the same manner as the corona generator 50 of FIGS. 1 and 2.

The corona generator 72 is isolated from the plenum 70 by an open ended and open top baffle 74 slidably engaging the back of the belt flight 38*a* at seals 76. This baffle prevents the vacuum air current flows in the plenum 70 from affecting the unobstructed ion charge flow from the transfer corona generator onto the back of the belt in the transfer nip, as referred to previously. Also, along with the shield of the corona generator 72, the baffle 74 serves to confine the area of the belt exposed to transfer charges.

In the embodiment of FIG. 3, there is additionally provided an a.c. transfer charge neutralizing corona generator 78 adjacent and directly downstream of the transfer corona generator 74 for substantially removing the transfer charges from the belt once transfer has been accomplished.

It will be appreciated that the thickness of the belt 38 and the spacing and dimensions of the vacuum apertures 40 therethrough are exaggerated in all of the drawings for clarity and are not to scale.

The problem to which the present application is specifically directed is that where an apertured vacuum transport belt carries the copy sheet through the transfer station, a corona charge placed to the back of the belt can cause uneven transfer fields from the vacuum holes in the belt if the belt is insulative (dielectric) unless the belt is very thin, yet the use of such a very thin belt has a number of mechanical and material disadvantages. Corona charge can pass up through the holes, and the dielectric constant of the air in the apertures will normally be sustantially different from that of the belt material. The uneven transfer fields can cause visible (print-out) defects in the copy. The solution disclosed in the original parent application, and discussed further here, is to use an electrically relaxable material for the solid apertured vacuum belt so that the transfer charge applied to the back of the vacuum belt will relax through the belt material from the back of the belt up toward the copy sheet transporting side of the belt. This results in the spacing of the transfer charges from the photoreceptor being approximately the same in the unapertured areas of the belt as in the apertured areas, and the elimination of the belt as an interventing dielectric between the transfer charges and the photoreceptor, and thus the transfer fields will be relatively constant between the apertured and unapertured belt areas. The relaxable belt material allows a substantially greater and uncompressed uniform transfer belt thickness of greater than 0.5 millimeters, and preferably 30–80 mils (0.76 – 2 millimeters) which is highly desirable for belt life and reliability and other mechanical considerations, particularly to avoid belt stretch or wrinkling during operation.

The holes or apertures in the belt are desirably large enough to provide sufficiently unobstructed air flow to hold porous paper against the belt and so as not to tend to become clogged with toner or paper lint particles, i.e., desirably larger than approximately 0.5 millimeters. This is practicable with a relaxable material belt. If, however, a dielectric belt would be utilized instead of the relaxable material belt, the increase in hole size would increase the tendency of the dielectric belt to cause transfer printout defects on the copy, particularly if the holes are larger than the copy sheet thickness, i.e., larger than approximately 4 mils (0.1 millimeter).

Hole print-out is a function of the difference in transfer efficiency between the hole and no hole belt areas. This efficiency difference is more critical at low transfer field levels (less than 20 volts/micron).

Referring to the specific resistivity characteristics desired for the electrically relaxable belt, this resistivity is selected by material selection to be between an upper and lower desired resistivity range limits. The upper limit or resistivity is that for which the belt would be too resistive to conduct the transfer charge through the belt rapidly enough, i.e., for the belt to have electrically relaxed within the transfer nip area at the process speed. This upper limit is approximately $(3.5 \times 10^{11})/K$ ohm-centimeters, where $K$ is the dielectric constant of the belt material at 10 inches per second belt speed. The lower resistivity limit is that for which the belt is too conductive and thus dissipates too much charge away from the transfer nip area to the pre-transfer area, causing air gap transfer and therefor image defects. This lower limit is approximately $(8.3 \times 10^9 T^2)/K$ ohm-centimeters, where T is the belt thickness (measured in millimeters) for a process speed of 10 inches per second. For a 30 mil (0.76 mm) belt thickness, this lower limit is thus approximately $(4.8 \times 10^9)/K$ ohm-centimeters. Thus, for an approximately 30 mil belt the allowable resistivity range or swing between this lower limit and the upper limit of $(3.5 \times 10^{11})/K$ ohm-centimeters is approximately 73 times. It may be seen that for a thicker belt of approximately 80 mils (2 mm) the lower resistivity limit will rise (by the $T^2$factor) to approximately $(3.3 \times 10^{10})/K$ here. This reduces the allowable resistivity range to approximately 10 times (one order of magnitude swing). However, such resistivity range materials are commercially available, for example, those used in the biased transfer roll of the Xerox "9200" duplicator. As noted, these resistivities are calculated from a typical 10 inch per second belt speed. For twice that belt speed the above resistivities would be reduced by only one-half. $K$ is approximately 4 for typical belt materials. Thus, the desired range may be further approximated to between $10^{11}$ and $10^9 T^2$ ohm-cm.

As indicated, the desired properties of a relaxable belt are that the charge should relax through the thickness in a time less than the corona charging time but should not relax in a lateral sense enough to cause pre-transfer or pre-nip fields high enough to cause gap transfer. This condition should exist throughout the range of belt resistivity. Further details as to resistivity calculations are provided here. The following will be assumed as conditions:

1. Corona charge time $= T_C = 0.1$ second. i.e. at 10 inches/second. Width of corona distribution = 1 inch.
2. Bulk relaxation time $=\tau = 0.3 \times T_c = 0.03$ second.
3. Lateral distance from pre-nip edge of corona distribution to pre-nip gap of 5 mil. (i.e. where gap transfer becomes objectionable) = = 1 inch.

From condition 2, the maximum belt volume resistivity would be:

$$\rho\gamma_{max} = \frac{\tau}{Keo} = \frac{.03}{K\ 8.85 \times 10^{-14}\ \text{farads/cm}} = \frac{3.4 \times 10\ \text{inch}}{K}$$

where $K$ is the dielectric constant of the belt material and Eo is the electrical permittivity constant.

In order to estimate the minumum resistivity to prevent gap transfer, it has been shown that a sheet of paper with a lateral resistivity ($\rho_L$) of $2.5 = 10^9$ohms and a dielectric thickness of 30 $\mu$ running at 10 inch/second will act as an insulator at a distance of 1 inch from the edge of the corona distribution. (i.e. "no"-charge at a point 1 inch from the edge of the corona distribution). The model also states that lateral charge relaxation will be proportional to dielectric thickness ($D_T$) and inversely proportional to process speed (S). Therefore, the minimum resistivity is:

$$\rho\gamma_{min} = P_L \cdot t_B = 2.5 \times 10^9 \times \frac{10\ \text{inch/second}}{S} \times \frac{D_T}{30\mu} \times t_B = \frac{8.33 \times 10^{12} t_B^2}{KS}$$

where $t_B$ = belt thickness (cm.) $D_T = t_B/K_B \times 10^4 \mu$/ cm

If it is required to have an allowable 100×resistivity swing, the maximum belt thickness would be:

$$t_{B_{max}}^2 = \frac{KS\ \rho\gamma\ \text{min}}{8.333 \times 10^{12}} = 4.08 \times 10^{-4}\ S$$

$$t_{B_{max}} = 2.02 \times 10^{-2}\ S^{1/2},\ \text{for}\ \Delta\rho\gamma = 100\text{X}$$

Therefore at 10 inches second, for $K = 4, \rho_{max} = 8.5 \times 10^{10}$ ohm-cm $\rho$min $= 8.5 \times 10^8$ohm-cm and $t_{B_{max}} = 0.639$ cm, or approximately 25 mil While the present invention haas been described in conjunction with specific embodiments thereof, various alternatives, modifications and variations will be apparent to those skilled in the art. It is intended to embrace all such alternatives, modifications and variations as fall within the spirit and scope of the claims.

What is claimed is:

1. In an electrostatographic printing system in which an image of imaging material on an image supporting member is transferred at a transfer station to copy sheets using electrical transfer fields generated by an electrical transfer corona charge generator, and wherein a copy sheet supporting belt with front and rear sides transports said copy sheets through said transfer station for said image transfer with said copy sheets supported on said front side of said belt for transfer juxtaposition with said image supporting member, the improvement wherein:

said copy sheet supporting belt comprises a thin solid uniform material of a thickness of approximately 0.76 to 2 millimeters between said front and rear sides and having a multiplicity of vacuum apertures between said front and rear sides with openings of greater than approximately 0.5 millimeters;

vacuum means are provided for applying vacuum forces through said copy sheet supporting belt vacuum apertures from the rear side of said belt to retain a copy sheet on said front side of said belt in said transfer station;

said transfer corona generator faces, but is spaced from, said rear side of said copy sheet supporting belt to apply transfer charges to said rear side of said belt, and said copy sheet supporting belt comprises an electrically relaxable material for resistively conducting said transfer charges from said rear side to said front side of said belt in said transfer station to avoid transfer discontinuities from said vacuum apertures.

2. The electrostatographic printing system of claim 1, wherein said belt has a resistivity of between approximately $(3.5 \times 10^{11})/K$ ohm-centimeters and $(8.3 \times 10^9 T^2)/K$ ohm-centimeters, where $T$ is the belt thickness measured in millimeters, and $K$ is the dielectric constant of the belt material.

3. The electrostatographic printing system of claim 2, wherein $K$ is 1.

4. The electrostatographic printing system of claim 1, wherein pneumatic baffle means are provided to shield said transfer corona generator from said vacuum means to prevent interference in the charging of said belt by said transfer corona generator.

5. The electrostatographic printing system of claim 1, wherein another corona generator means is positioned closely adjacent said transfer corona generator to at least partially neutralize charges placed on said belt by said transfer corona generator.

* * * * *